US011676757B2

(12) United States Patent
Otani et al.

(10) Patent No.: US 11,676,757 B2
(45) Date of Patent: Jun. 13, 2023

(54) ELECTRONIC COMPONENT AND METHOD OF MANUFACTURING ELECTRONIC COMPONENT

(71) Applicant: Murata Manufacturing Co., Ltd., Kyoto-fu (JP)

(72) Inventors: Shinji Otani, Nagaokakyo (JP); Yuuta Hoshino, Nagaokakyo (JP); Toshihiko Kobayashi, Nagaokakyo (JP); Tomotaka Gotohda, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 344 days.

(21) Appl. No.: 16/930,093

(22) Filed: Jul. 15, 2020

(65) Prior Publication Data

US 2021/0043369 A1 Feb. 11, 2021

(30) Foreign Application Priority Data

Aug. 9, 2019 (JP) ..... JP2019-147659

(51) Int. Cl.

| | |
|---|---|
| ***H01F 17/04*** | (2006.01) |
| ***H01F 27/32*** | (2006.01) |
| ***H01F 27/28*** | (2006.01) |
| ***H01F 41/061*** | (2016.01) |
| ***H01F 27/29*** | (2006.01) |
| ***H01F 41/12*** | (2006.01) |
| ***H01F 27/24*** | (2006.01) |

(52) U.S. Cl.

CPC ..... *H01F 27/32* (2013.01); *H01F 27/24* (2013.01); *H01F 27/2823* (2013.01); *H01F 27/29* (2013.01); *H01F 41/061* (2016.01); *H01F 41/12* (2013.01)

(58) Field of Classification Search

CPC ..... H01F 27/32
USPC ..... 336/221
See application file for complete search history.

(56) References Cited

U.S. PATENT DOCUMENTS

2016/0027574 A1* 1/2016 Aoki ..... H01F 17/045 336/192
2016/0118183 A1 4/2016 Wada
2016/0172110 A1* 6/2016 Otani ..... H01G 4/30 361/301.4
2016/0260535 A1* 9/2016 Kubota ..... H01F 17/0013
(Continued)

FOREIGN PATENT DOCUMENTS

JP H06-031112 A 2/1994
JP H08-273947 A 10/1996
JP H10-172832 A 6/1998
(Continued)

OTHER PUBLICATIONS

English translation of CN 1697098 (Year: 2005).*
(Continued)

*Primary Examiner* — Ronald Hinson
(74) *Attorney, Agent, or Firm* — Studebaker & Brackett PC

(57) ABSTRACT

An insulating layer, which is composed of a material having a higher insulating property than a core, partially covers a surface of the core. A plating layer, which functions as an electrode, is stacked on a surface of the insulating layer. The surface area of the insulating layer is larger than the surface area of the plating layer and the plating layer is stacked inside a region covered by the insulating layer.

20 Claims, 5 Drawing Sheets

(56) References Cited

U.S. PATENT DOCUMENTS

2019/0180926 A1 6/2019 Kojima et al.

FOREIGN PATENT DOCUMENTS

| | | | |
|---|---|---|---|
| JP | 2013-118314 | A | 6/2013 |
| JP | 2016-086123 | A | 5/2016 |
| JP | 2019-106393 | A | 6/2019 |

OTHER PUBLICATIONS

An Office Action; "Notice of Reasons for Refusal," mailed by the Japanese Patent Office dated Mar. 29, 2022, which corresponds to Japanese Patent Application No. 2019-147659 is related to U.S. Appl. No. 16/930,093 with English language translation.

* cited by examiner

FIG. 11

| LENGTH DIRECTION Ld (μm) | WIDTH DIRECTION Wd (μm) | ONE SIDE OF WINDING CORE PART (μm) | FLANGE HEIGHT DIRECTION Ld (μm) | FLANGE HEIGHT/ ONE SIDE OF WINDING CORE PART |
|---|---|---|---|---|
| 400 | 200 | 150 | 10 | 0.07 |
| 400 | 200 | 150 | 30 | 0.20 |
| 400 | 200 | 150 | 50 | 0.33 |
| 400 | 200 | 200 | 10 | 0.05 |
| 400 | 200 | 200 | 30 | 0.15 |
| 400 | 200 | 200 | 50 | 0.25 |
| 400 | 200 | 250 | 10 | 0.04 |
| 400 | 200 | 250 | 30 | 0.12 |
| 400 | 200 | 250 | 50 | 0.20 |
| 700 | 300 | 320 | 85 | 0.27 |
| 800 | 400 | 200 | 65 | 0.33 |
| 800 | 400 | 200 | 83 | 0.42 |
| 800 | 400 | 243 | 65 | 0.27 |
| 800 | 400 | 243 | 83 | 0.34 |
| 1000 | 500 | 270 | 120 | 0.44 |
| 1000 | 500 | 270 | 130 | 0.48 |
| 1000 | 500 | 320 | 120 | 0.38 |
| 1000 | 500 | 320 | 130 | 0.41 |
| 1000 | 500 | 370 | 120 | 0.32 |
| 1000 | 500 | 370 | 130 | 0.35 |
| 1000 | 500 | 430 | 120 | 0.28 |
| 1000 | 500 | 430 | 130 | 0.30 |
| 1600 | 800 | 400 | 160 | 0.40 |
| 1600 | 800 | 400 | 170 | 0.43 |
| 1600 | 800 | 450 | 160 | 0.36 |
| 1600 | 800 | 450 | 170 | 0.38 |
| 1600 | 800 | 500 | 160 | 0.32 |
| 1600 | 800 | 500 | 170 | 0.34 |
| 1600 | 800 | 520 | 160 | 0.31 |
| 1600 | 800 | 520 | 170 | 0.33 |
| 2000 | 1200 | 790 | 240 | 0.30 |
| 2000 | 1200 | 790 | 260 | 0.33 |
| 2000 | 1200 | 790 | 290 | 0.37 |

ELECTRONIC COMPONENT AND METHOD OF MANUFACTURING ELECTRONIC COMPONENT

CROSS-REFERENCE TO RELATED APPLICATION

This application claims benefit of priority to Japanese Patent Application No. 2019-147659, filed Aug. 9, 2019, the entire content of which is incorporated herein by reference.

BACKGROUND

Technical Field

The present disclosure relates to an electronic component and a method of manufacturing an electronic component.

Background Art

The core of an electronic component disclosed in Japanese Unexamined Utility Model Registration Application Publication No. 6-31112 includes a substantially column-shaped winding core part around which a winding wire is wound and flange parts that are connected to the ends of the winding core part. An insulating layer is stacked on one surface of each flange part. A plating layer functioning as an electrode is stacked on the surface of each insulating layer.

Regarding the core disclosed in Japanese Unexamined Utility Model Registration Application Publication No. 6-31112, when the electrodes are deposited by performing plating, the electrodes may grow until they touch the surface of the core during the deposition process. If the electrodes come into contact with the surface of the core during the deposition process, the deposition of the electrodes will be accelerated by a small current flowing through the core when the deposition is being carried out by performing plating, and consequently there is a risk that the electrodes will be deposited over an excessively wide area compared to the designed area. The same problem similarly occurs in electronic components in which electrodes are deposited on a core regardless of the shape of the core.

SUMMARY

Accordingly, a preferred embodiment of the present disclosure provides an electronic component that includes a component body; an insulating layer that is formed of a material having a higher insulating property than the component body and that partially covers a surface of the component body; and an electrode that is stacked on a surface of the insulating layer. The electrode includes a base electrode that is stacked on the surface of the insulating layer and a plating layer that is stacked on a surface of the base electrode. The insulating layer has a larger surface area than the electrode and the electrode is stacked at a position separated from an edge of the insulating layer.

Also, a preferred embodiment of the present disclosure provides a method of manufacturing an electronic component that includes a component body, an insulating layer that is formed of a material having a higher insulating property than the component body and that partially covers a surface of the component body, and an electrode that is stacked on a surface of the insulating layer. The method includes a step of preparing an insulator having a higher insulating property than the component body and a conductor having a higher conductivity than the insulator; an insulator applying step of applying the insulator to part of a surface of the component body by dipping part of the component body in the insulator; a conductor applying step of applying the conductor to part of a surface of the insulator by dipping part of the surface of the insulator applied to the surface of the component body in the conductor; a hardening step of hardening the insulator to form the insulating layer and hardening the conductor to form the base electrode; and a plating step of forming an electrode on a surface of the base electrode through plating. The conductor is applied at a position separated from an edge of the insulator applied to the surface of the component body in the conductor applying step.

According to the above preferred embodiments, a part where the surface of the component body is exposed and at least part of an edge of the electrode are separated from each other. Therefore, it is possible to suppress excessive growth of the electrode resulting from a small current flowing through the component body.

According to the electronic component and the method of manufacturing an electronic component of the preferred embodiments of the present disclosure, it is possible to suppress deposition of an electrode over an excessively wide area.

Other features, elements, characteristics and advantages of the present disclosure will become more apparent from the following detailed description of preferred embodiments of the present disclosure with reference to the attached drawings.

BRIEF DESCRIPTION OF THE DRAWINGS

FIG. 11 is table listing core sizes.

DETAILED DESCRIPTION

Figure 1:
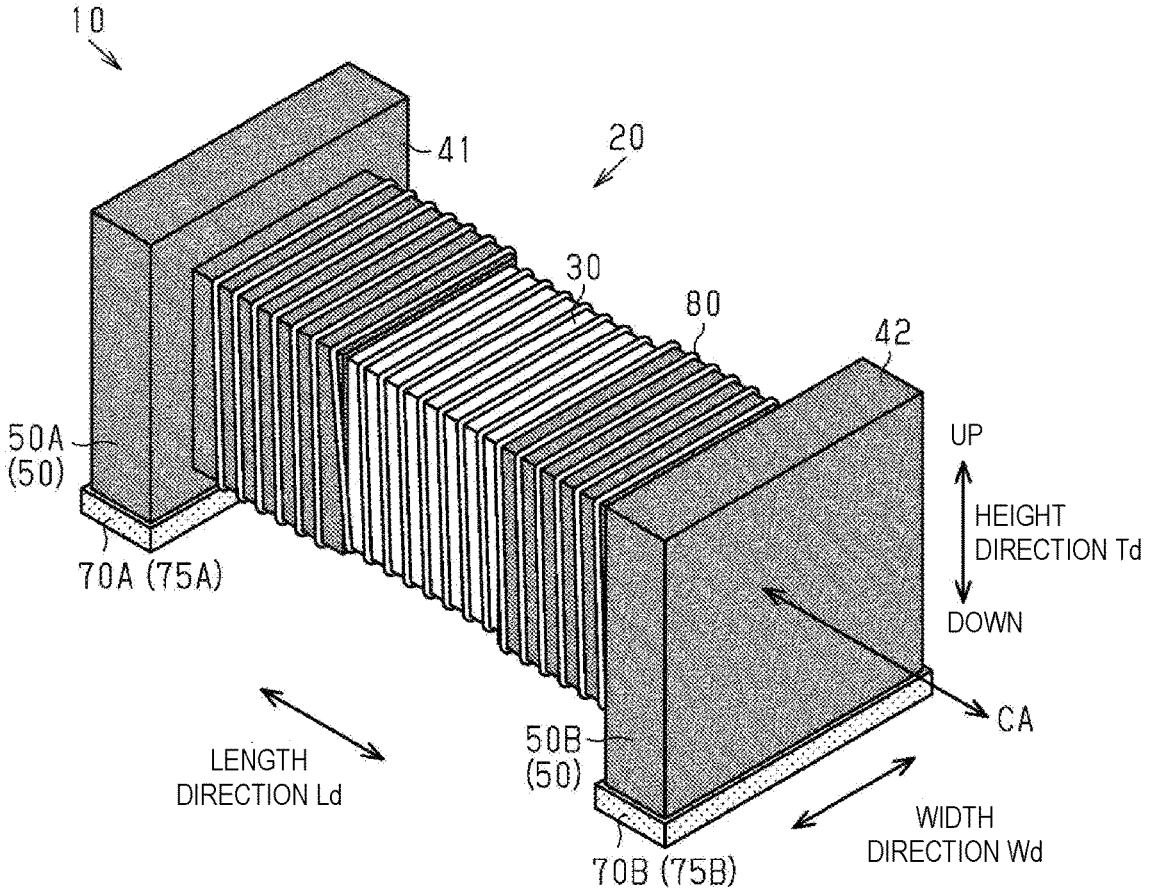
FIG. 1 is a perspective view of an electronic component of a first embodiment.

Hereafter, electronic components and methods of manufacturing an electronic component according to embodiments of the present disclosure will be described while referring to the drawings. In the drawings, constituent elements may be illustrated in an enlarged manner for ease of understanding. The dimensional ratios of the constituent elements may differ from the actual ratios or may differ from the ratios in other drawings.

First Embodiment

First, an electronic component and a method of manufacturing an electronic component according to a first embodiment will be described.

As illustrated in FIG. 1, a wound-wire-type inductor component 10, which is an electronic component, is a surface mount inductor component 10 that is to be mounted on a circuit board or the like. The inductor component 10 includes a core 20, which is a component body of the inductor component 10, and a winding wire 80, which is wound around the core 20. The material of the core 20 is a magnetic material such as a nickel-zinc ferrite. The core 20 is formed by firing a molded body obtained by compressing the magnetic material in the form of a powder. Note that illustration of the winding wire 80 of the inductor component 10 is omitted from the drawings other than FIG. 1.

The core 20 includes a substantially square prism-shaped winding core part 30, a first flange part 41 connected to a first end of the winding core part 30 in the direction of a center axis CA of the winding core part 30, and a second flange part 42 connected to a second end of the winding core part 30 in the direction of the center axis CA of the winding core part 30. Note that the direction of the center axis CA of the winding core part 30 is referred to as a length direction Ld in the following description.

The first flange part 41 has a substantially flat rectangular parallelepiped shape with a small dimension in the length direction Ld. The first flange part 41 has a substantially square shape when viewed in the length direction Ld. In addition, each side of the square shape of the first flange part 41 is parallel to the corresponding outer peripheral surface of the winding core part 30 when viewed in the length direction Ld. The center of the first flange part 41 coincides with the center axis CA of the winding core part 30 when viewed in the length direction Ld. The first flange part 41 is larger than the winding core part 30 when viewed in the length direction Ld. In other words, the outer peripheral portion of the first flange part 41 protrudes outwardly from the outer peripheral surfaces of the winding core part 30. The configuration of the second flange part 42 is identical to that of the first flange part 41 except that the second flange part 42 is connected to the second end of the winding core part 30. Note that one outer peripheral surface among the four outer peripheral surfaces of the first flange part 41 serves as a mounting surface that faces the substrate or the like when the inductor component 10 is mounted on a substrate or the like. In the following description, the side where the mounting surface of the first flange part 41 is located will be referred to as the lower side in a height direction Td. In addition, a direction that is perpendicular to the length direction Ld and the height direction Td will be referred to as a width direction Wd. In FIG. 1, the height direction of the inductor component 10 is depicted as being aligned with an up-down direction.

Figure 2:
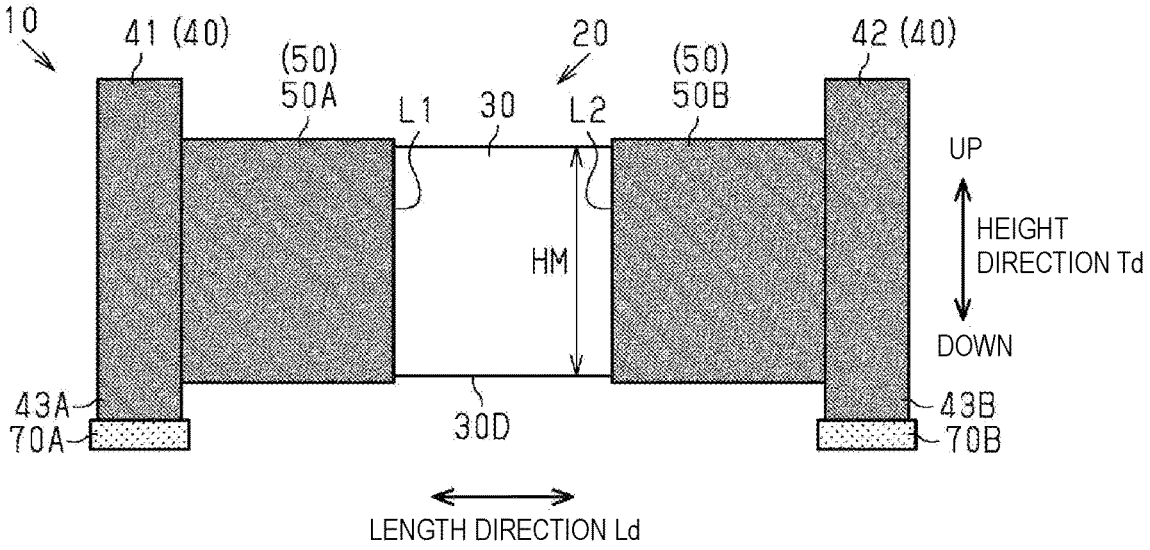
FIG. 2 is a side view of the electronic component of the first embodiment.

As illustrated in FIG. 2, the surfaces of the core 20 are partially covered by an insulating layer 50. The insulating layer 50 is broadly divided into a first insulating layer 50A and a second insulating layer 50B. Note that the insulating layer 50 is shaded with dots in some of the drawings such as FIGS. 1 and 2. The material of the insulating layer 50 is a glass containing silicon oxide. In other words, the material of the insulating layer 50 is a material having a higher insulating property than the material of the core 20.

The first insulating layer 50A covers one side of the core 20 in the length direction Ld. Specifically, the first insulating layer 50A covers the entirety of each surface of the first flange part 41 and covers the surfaces of the winding core part 30 from the first end side of the winding core part 30 in the length direction Ld up to around one third of the total length of the winding core part 30 in the length direction Ld. In addition, the second insulating layer 50B similarly covers the second end side of the core 20 in the length direction Ld. In other words, the second insulating layer 50B covers the entirety of each surface of the second flange part 42 and covers the surfaces of the winding core part 30 from the second end side of the winding core part 30 in the length direction Ld up to around one third of the total length of the winding core part 30 in the length direction Ld. On the other hand, the insulating layer 50 does not cover the surfaces of a central portion of the winding core part 30 in the length direction Ld that extends through around one third of the total length of the winding core part 30 in the length direction Ld and the surfaces of this central portion of the winding core part 30 are exposed. In other words, a first boundary L1 between the parts of the surfaces of the core 20 covered by the first insulating layer 50A and the parts of the surfaces of the core 20 not covered by the first insulating layer 50A is located on the winding core part 30. The first boundary L1 extends along the four outer peripheral surfaces of the winding core part 30 parallel to the center axis CA so as to encircle the winding core part 30. Similarly, a second boundary L2 between the parts of the surfaces of the core 20 covered by the second insulating layer 50B and the parts of the surfaces of the core 20 not covered by the second insulating layer 50B is located on the winding core part 30.

Figure 3:
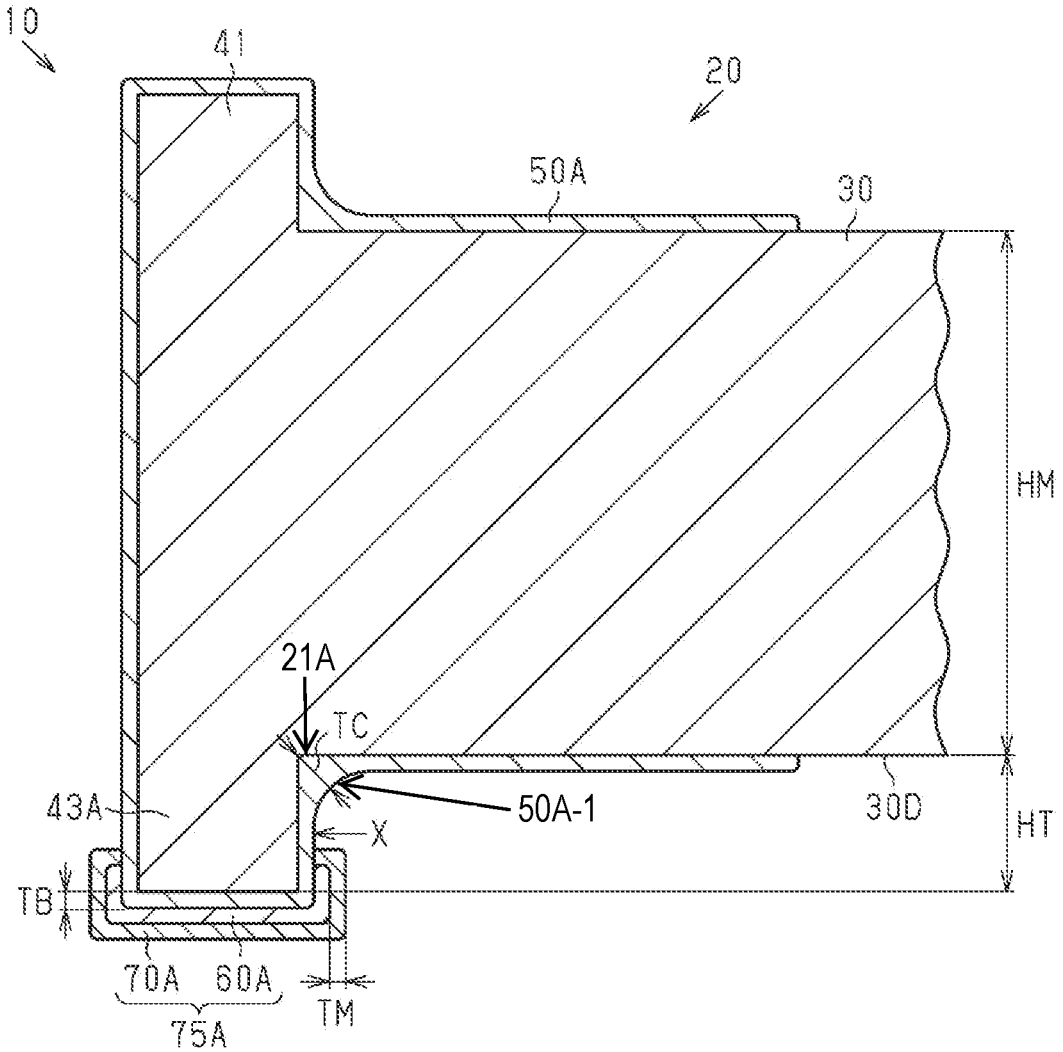
FIG. 3 is an enlarged sectional view of the electronic component of the first embodiment.

As described above, the insulating layer 50 covers the entirety of each surface of the first flange part 41 and the second flange part 42 and covers the surfaces of the winding core part 30 from each end of the winding core part 30 in the length direction Ld up to around one third of the total length of the winding core part 30 in the length direction Ld. Therefore, as illustrated in FIG. 3, the first insulating layer 50A also covers a first connection point 21A between the outer peripheral surfaces of the winding core part 30 and a first protruding portion 43A, which is the part of the first flange part 41 that protrudes outwardly from the outer peripheral surfaces of the winding core part 30. The curvature of the surface 50A-1 of the part of the first insulating layer 50A covering the first connection point 21A is smaller than the curvature of the first connection point 21A when the inductor component 10 is viewed in a cross section including the center axis CA of the winding core part 30. Note that the first connection point 21A is depicted as being substantially shaped like a right angle in FIG. 3 as an example in which the curvature of the first connection point 21A is very large. In addition, although not illustrated, in the first embodiment, at a second connection point between the winding core part 30 and a second protruding portion 43B, which is the protruding part of the second flange part 42 that outwardly protrudes from the outer peripheral surfaces of the winding core part 30, the curvature of the surface of the part of the second insulating layer 50B covering the second connection point is similarly smaller than the curvature of the second connection point. In this embodiment, the curvature of each connection point is measured by polishing a cross-section of the inductor component 10, which includes the connection point and is perpendicular to the width direction Wd, and then observing the cross section with a microscope at a magnification of 300 times. Then, the curvature at each connection point is taken to be the average value of three measurement data points in the field of view observed in the cross section perpendicular to the width direction Wd.

A first base electrode 60A is stacked on the surface of the part of the insulating layer 50 on the first protruding portion 43A of the first flange part 41. The first base electrode 60A covers the surface of approximately the lower one third of the part of the first protruding portion 43A that is below the winding core part 30. Therefore, the surface area of the first base electrode 60A is smaller than the surface area of the first insulating layer 50A. In addition, the first base electrode 60A is arranged at a position separated from the edge of the first insulating layer 50A. In other words, the first base electrode 60A is arranged inside the region covered by the first insulating layer 50A. The thickness of the first base electrode 60A is smaller than the thickness of the first insulating layer 50A. The material of the first base electrode 60A is composed of silicon oxide and silver, which is a conductor. Therefore, the first base electrode 60A has a certain degree of conductivity overall. In addition, silicon is included as a shared inorganic component as a component of the first base electrode 60A and a component of the first insulating layer 50A. Furthermore, although not illustrated, in the first embodiment, a second base electrode is similarly stacked on the surface of the second insulating layer 50B on the second protruding portion 43B of the second flange part 42. The surface area of the second base electrode is smaller than the surface area of the second insulating layer 50B. In addition, the second base electrode is arranged at a position separated from the edge of the second insulating layer 50B.

A first plating layer 70A is stacked on the surface of the first base electrode 60A. In other words, the surface of the inductor component 10 consists of the first plating layer 70A from the lower surface of the first flange part 41 in the height direction Td to a position on the first flange part 41 that is lower than the lower edge of the winding core part 30 in the height direction Td. Therefore, the surface area of the first plating layer 70A is smaller than the surface area of the first insulating layer 50A. In addition, the first plating layer 70A is arranged at a position separated from the edge of the first insulating layer 50A. In other words, the first plating layer 70A is arranged inside the region covered by the first insulating layer 50A. Similarly, in the first embodiment, a second plating layer 70B is stacked on the surface of the second base electrode. The surface area of the second plating layer 70B is smaller than the surface area of the second insulating layer 50B. In addition, the second plating layer 70B is arranged at a position separated from the edge of the second insulating layer 50B. In the first embodiment, a first electrode 75A is formed by the first base electrode 60A and the first plating layer 70A. Therefore, the surface area of the first electrode 75A is smaller than the surface area of the first insulating layer 50A. In addition, the first electrode 75A is arranged at a position separated from the edge of the first insulating layer 50A. In other words, the first electrode 75A is arranged inside the region covered by the first insulating layer 50A. In addition, although not illustrated, a second electrode 75B is formed by the second base electrode and the second plating layer 70B. The surface area of the second electrode 75B is smaller than the surface area of the second insulating layer 50B. In addition, the second electrode 75B is arranged at a position separated from the edge of the second insulating layer 50B. In other words, the second electrode 75B is arranged inside the region covered by the second insulating layer 50B.

A thickness TM of the first plating layer 70A, as illustrated in FIG. 3, is around 20 μm in the first embodiment. In this embodiment, the thickness of the first plating layer 70A is measured by polishing a cross section of the inductor component 10 and then observing the cross section with a microscope at a magnification of 300 times. The thickness TM of the first plating layer 70A is taken to be the average value of the thickness of the first plating layer 70A from the edge of the first base electrode 60A as measured at three points in the observed field of view.

The thickness of the first insulating layer 50A lies in a range from 10 nm to 1.5 μm at a position X that is separated by a distance of 0.6 times the thickness TM of the first plating layer 70A from the edge of the first base electrode 60A toward the edge of the first insulating layer 50A. In other words, the minimum thickness of the first insulating layer 50A at the position X is greater than or equal to 10 nm and the maximum thickness of the first insulating layer 50A at the position X is less than or equal to 1.5 μm. Note that the thickness of the first insulating layer 50A is illustrated in an exaggerated manner in the drawings. In addition, the thickness of the first insulating layer 50A at the position X is identical to a thickness TB of the part of the first insulating layer 50A interposed between the first plating layer 70A and the core 20. Comparing the thickness TB of the first insulating layer 50A and a thickness TC of the first insulating layer 50A at the first connection point 21A, the thickness TC of the first insulating layer 50A at the first connection point 21A is larger than the thickness TB, which is the thickness TB of the part of the first insulating layer 50A interposed between the first plating layer 70A and the core 20. Note that, in the first embodiment, although not illustrated, the thicknesses of the first insulating layer 50A and the second insulating layer 50B are identical and the thicknesses of the first plating layer 70A and the second plating layer 70B are also identical. In this embodiment, the thickness of the first insulating layer 50A at the position X is measured by polishing a cross section of the inductor component 10 that includes the position X and is perpendicular to the height direction Td and then observing the cross section with a microscope at a magnification of 300 times. The thickness of the first insulating layer 50A is taken to be the average value of the thickness of the first insulating layer 50A from the edge of the core 20 as measured at three points in the observed field of view of the cross section perpendicular to the width direction Wd.

The dimension of the inductor component 10 in the length direction Ld is 800 μm. Furthermore, the dimensions of the inductor component 10 in the height direction Td and the width direction Wd are 400 μm. In addition, the length of each side of the square shape of the winding core part 30 when the winding core part 30 is viewed in the length direction Ld is 240 μm.

Here, a flange height HT is the length in a direction perpendicular to the center axis CA of the winding core part 30 from a bottom surface 30D, which is the lower surface in the height direction Td among the outer peripheral surfaces of the winding core part 30 that are parallel to the center axis CA, to the protruding leading ends of the first flange part 41 and the second flange part 42 in the height direction Td. The bottom surface 30D functions as one surface among the outer peripheral surfaces of the winding core part 30 that are parallel to the center axis CA of the winding core part 30. The flange height HT is 65 μm. Similarly, the flange heights HT from the three other outer peripheral surfaces of the winding core part 30 to the corresponding surfaces of the protruding leading ends of the first flange part 41 and the second flange part 42 are also 65 μm. A value obtained by dividing 65 μm, which is the flange height HT, by the dimension HM of the winding core part 30 in the height direction Td, i.e., 240 μm, which is the length of each side of the square shape of the winding core part 30, is 0.27.

In this embodiment, the flange height HT is measured by polishing a cross section of the inductor component 10 that is perpendicular to the width direction Wd and observing the cross section with a microscope at a magnification of 300 times. The flange height HT is taken to be the average value of a dimension from the edge of the bottom surface 30D to the leading end of the first flange part 41 as measured at three points in the observed field of view.

As illustrated in FIG. 1, the winding wire 80 is wound around the winding core part 30 of the core 20. One end of the winding wire 80 is connected to the first electrode 75A on the first flange part 41 and the other end of the winding wire 80 is connected to the second electrode 75B on the second flange part 42.

Next, a method of manufacturing the inductor component 10 will be described.

The method of manufacturing the inductor component 10 includes a core preparing step, an insulator applying step, a conductor applying step, a heating step, and a plating step.

First, in the core preparing step, the core 20 is formed by firing a molded body obtained by compressing a powdered magnetic substance using a mold. In the first embodiment, the winding core part 30, the first flange part 41, and the second flange part 42 are formed when the core 20 is formed using the mold.

Figure 4:
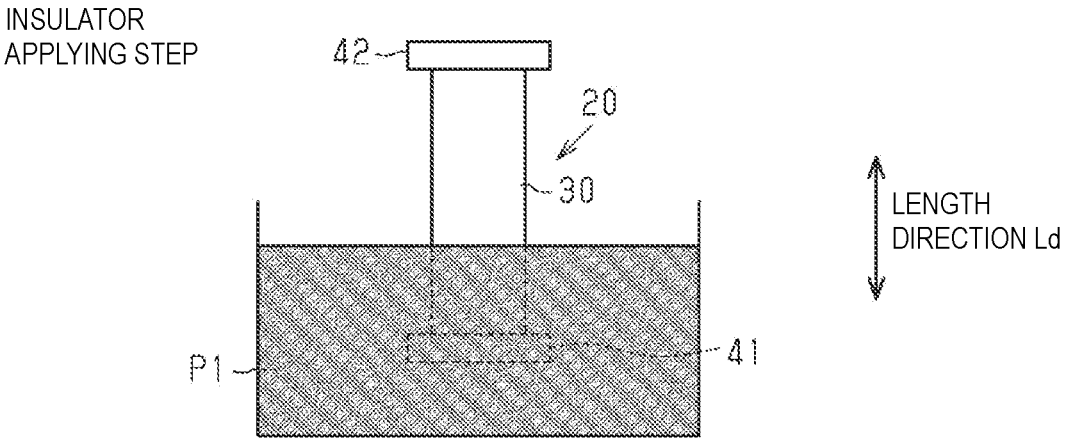
FIG. 4 is an explanatory diagram for an insulator applying step of the first embodiment.

The insulator applying step is formed after the core preparing step. As illustrated in FIG. 4, the insulator applying step can be broadly divided into two applying steps, namely, a first applying step and a second applying step. In the first applying step, an insulator sol P1 containing a metal alkoxide is applied to the first end of the core 20 in the length direction Ld. Specifically, the insulator sol P1 is applied to the entirety of the first flange part 41 and from the first end of the winding core part 30 in the length direction Ld up to a point at around one third the total length of the winding core part 30 in the length direction Ld. The insulator sol P1 is a sol in the state of a solution, and when the sol is dried, the sol becomes a gel having a higher viscosity than the sol, and when the gel is further dried, the gel becomes a solid material. This insulator sol P1 forms the insulating layer 50 containing silicon oxide in the heating step described later.

Figure 5:
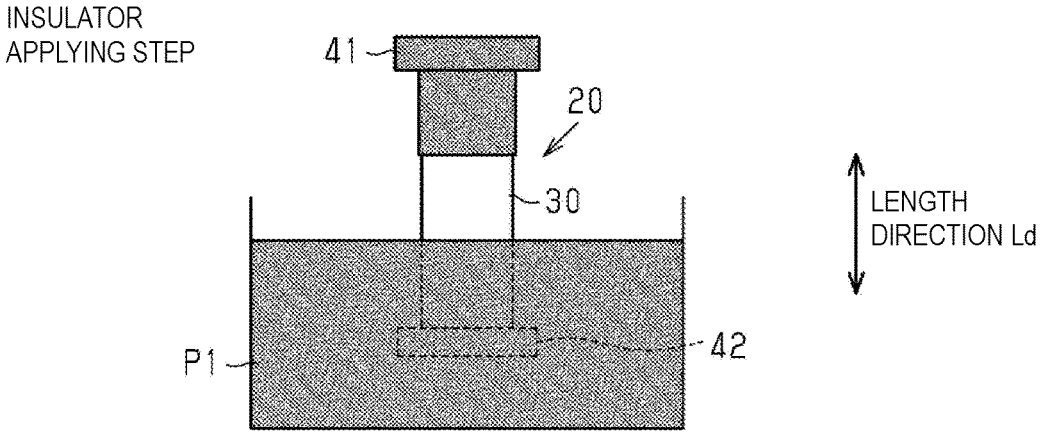
FIG. 5 is an explanatory diagram for an insulator applying step of the first embodiment.

Next, as illustrated in FIG. 5, the insulator sol P1 is applied to the second end of the core 20 in the length direction Ld in the second applying step. Specifically, the insulator sol P1 is applied to the entirety of the second flange part 42 and from the second end of the winding core part 30 in the length direction Ld up to a point at around one third the total length of the winding core part 30 in the length direction Ld. The insulator sol P1 that has been applied to the core 20 is then dried.

Figure 6:
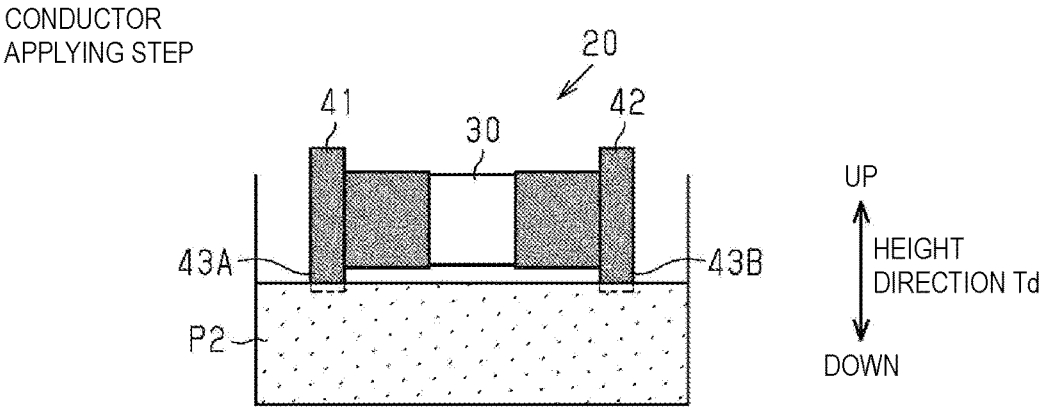
FIG. 6 is an explanatory diagram for a conductor applying step of the first embodiment.

Next, as illustrated in FIG. 6, in the conductor applying step, a conductor sol P2 containing a metal alkoxide is applied to the parts of the first protruding portion 43A and the second protruding portion 43B where the first electrode 75A and the second electrode 75B are to be provided that are located on the lower side of the core 20 in the height direction Td. Specifically, the conductor sol P2 is applied to the surface of the insulator sol P1, i.e., inside the region covered by the insulator sol P1 applied to the surfaces of the core 20 and away from the edge of the insulator sol P1 applied to the surfaces of the core 20. In other words, a conductor sol P2 is applied over a narrower region than the insulator sol P1. Therefore, the edge of the applied conductor sol P2 and the edge of the applied insulator sol P1 are separated from each other. Then, the conductor sol P2 that has been applied to the core 20 is dried. The conductor sol P2 is a sol in the state of a solution, and when the sol is dried, the sol becomes a gel with a higher viscosity than the sol, and when the gel is further dried, the gel becomes a solid material. The applied conductor sol P2 forms the first base electrode 60A and the second base electrode containing silicon oxide and silver, which is a conductor, in the heating step described later.

Next, in the heating step, the core 20 to which the insulator sol P1 and the conductor sol P2 have been applied is heated. The heating step functions as a hardening step and both the insulator sol P1 and the conductor sol P2 are heated. As a result, the first insulating layer 50A and the second insulating layer 50B, which partially cover the surfaces of the core 20, are fired, and the first base electrode 60A and the second base electrode disposed on the surfaces of the first insulating layer 50A and the second insulating layer 50B are fired. In other words, the insulator sol P1 is hardened and forms the first insulating layer 50A and the second insulating layer 50B and the conductor sol P2 is hardened and forms the first base electrode 60A and the second base electrode.

Next, in the plating step, plating is performed on parts of the first base electrode 60A and the second base electrode. As a result, the first plating layer 70A is formed on the surface of the first base electrode 60A and the second plating layer 70B is formed on the surface of the second base electrode. Although not illustrated, the first plating layer 70A and the second plating layer 70B each have a three-layer structure in which layers of nickel, copper, and tin are stacked on top of each other.

Next, the actions and effects of the above-described first embodiment will be described.

(1) For example, in the case where the first plating layer 70A is grown on a core 20 not covered by the insulating layer 50 by energizing the first base electrode 60A, the first plating layer 70A basically grows on the first base electrode 60A in the plating step. However, since the core 20 contains a conductive material such as copper as an impurity, a small current also flows through the core 20. Therefore, the first plating layer 70A not only grows on the first base electrode 60A but also on the core 20 in a direction along the surfaces of the core 20. In this case, the first plating layer 70A is formed excessively beyond the region covered by the first base electrode 60A applied to form the first electrode 75A.

According to the first embodiment, the insulating layer 50, which has a higher insulating property than the core 20, partially covers the surfaces of the core 20. Furthermore, the surface area of the insulating layer 50 is larger than the surface area of the first plating layer 70A that functions as the first electrode 75A and the surface area of the second plating layer 70B that functions as the second electrode 75B. Furthermore, the first plating layer 70A and the second plating layer 70B are stacked at positions separated from the edges of the insulating layer 50 inside the regions covered by the insulating layer 50. Therefore, the part where the surfaces of the core 20 are exposed and the edges of the first plating layer 70A are separated from each other. Similarly, the part where the surfaces of the core 20 are exposed and the edges of the second plating layer 70B are separated from each other. Therefore, it is possible to suppress excessive growth of the first plating layer 70A and the second plating layer 70B caused by a small current flowing through the core 20.

(2) In the wound-wire-type inductor component 10, the winding wire 80 is wound around the winding core part 30, and thus portions of the winding wire 80 are located near the first plating layer 70A and the second plating layer 70B. Therefore, if the first plating layer 70A and the second plating layer 70B grow excessively, it is easy for the first plating layer 70A and the second plating layer 70B to come into contact with the winding wire 80 wound around the winding core part 30. In order avoid such contact, higher accuracy is required for the dimensions of the first plating layer 70A and the second plating layer 70B. Regarding the shape of the core 20 in the above-described first embodiment, it is highly preferable that excessive growth of the first plating layer 70A and the second plating layer 70B along the surfaces of the core 20 be suppressed.

(3) In the first embodiment, a value obtained by dividing the flange height HT by the dimension HM of the winding core part 30 in the height direction Td is 0.27 and therefore the size of the flange height HT relative to the length of one side of the winding core part 30 is reasonably small. In addition, the flange height HT is reasonably small at 65 μm. Therefore, for example, if the first plating layer 70A stacked on at least part of the first flange part 41 grows excessively along the surfaces of the core 20 up to the vicinity of the winding core part 30, it would be particularly easy for the first plating layer 70A to come into contact with the winding wire 80 wound around the winding core part 30. According to the above-described first embodiment, excessive growth of the first plating layer 70A and the second plating layer 70B along the surfaces of the core 20 is suppressed, and therefore it is possible to prevent the first plating layer 70A and the second plating layer 70B from coming into contact with the winding wire 80 even though the flange height HT is reasonably small.

(4) In the above-described first embodiment, the first insulating layer 50A covers the entire surfaces of the first flange part 41. Therefore, the length from the edge of the first base electrode 60A in the direction along the surface of the core 20 to the edge of the first insulating layer 50A is very large relative to the thickness TM of the first plating layer 70A. Therefore, even if the first plating layer 70A unintentionally grows in a direction along the surfaces of the core 20 during the plating step, a situation in which the first plating layer 70A comes into contact with the part of the core 20 exposed from the first insulating layer 50A can be more reliably suppressed.

(5) According to the first embodiment, the first boundary L1 between the part covered by the first insulating layer 50A and the part not covered by the insulating layer 50 is located on the winding core part 30 and the entire surfaces of the first flange part 41 including the end surface of the first flange part 41 on the outside in the length direction Ld are covered by the first insulating layer 50A. Therefore, fine scratches and cracks in the surface of the first flange part 41 are filled by the first insulating layer 50A and an improvement in the strength of the inductor component 10 can be expected.

(6) In the first embodiment, the first connection point 21A has an angular shape and it is easy for stress to become concentrated at the first connection point 21A. According to the first embodiment, the first insulating layer 50A covers the first connection point 21A and as a result the strength is improved. In addition, the curvature of the surface of the part of the first insulating layer 50A covering the first connection point 21A is smaller than the curvature of the first connection point 21A when viewed in a cross section including the center axis of the winding core part 30. Therefore, an external force acting on the first connection point 21A is easily dispersed. Therefore, it is possible to prevent the inductor component 10 from being damaged at the first connection point 21A.

(7) In the first embodiment, the thickness TC of the insulating layer 50 at the first connection point 21A is larger than the thickness TB which is the thickness of the part of the first insulating layer 50A interposed between the first plating layer 70A and the core 20. Therefore, the first connection point 21A, where an external force acting on the inductor component 10 is likely to be concentrated, is covered by the comparatively thick first insulating layer 50A. Therefore, a strength improvement effect of the insulating layer 50 can be effectively obtained at the first connection point 21A.

(8) According to experiments and so forth, when the first plating layer 70A is grown on a core 20 not covered by the insulating layer 50 by energizing the first base electrode 60A, the first plating layer 70A grows from the edge of the first base electrode 60A within a distance of 0.6 times the thickness of the first plating layer 70A. According to the first embodiment, the minimum thickness of the first insulating layer 50A at a position at a distance of 0.6 times the thickness TM of the first plating layer 70A from the edge of the first base electrode 60A toward the edge of the first insulating layer 50A is 10 nm. Therefore, supposing there is no first insulating layer 50A, when the range in which the first plating layer 70A will grow is referred to as an assumed range, the first insulating layer 50A having a thickness capable of preventing conduction between the first plating layer 70A and the core 20 is disposed so as to include this assumed range. Therefore, growth of the first plating layer 70A along the surfaces of the core 20 can be suppressed.

(9) According to the first embodiment, the maximum thickness of the first insulating layer 50A at a position at a distance of 0.6 times the thickness TM of the first plating layer 70A from the edge of the first base electrode 60A toward the edge of the first insulating layer 50A is 1.5 nm, which is reasonably small. Therefore, an excessive increase in the size of the inductor component 10 can be suppressed.

(10) According to the first embodiment, silicon is included as a shared inorganic component in the insulating layer 50, the first base electrode 60A, and the second base electrode. Therefore, sintering can be performed using the same heating conditions when sintering the insulator sol P1 and the conductor sol P2. Therefore, the insulating layer 50, the first base electrode 60A, and the second base electrode can be sintered in a single heating step rather than performing separate heating steps and therefore the number of steps can be reduced.

Second Embodiment

Next, an electronic component and a method of manufacturing the electronic component according to a second embodiment will be described. Note that in the following description of the second embodiment, constituent elements that are the same as in the first embodiment are denoted by the same symbols and specific description thereof is omitted or simplified.

Figure 7:
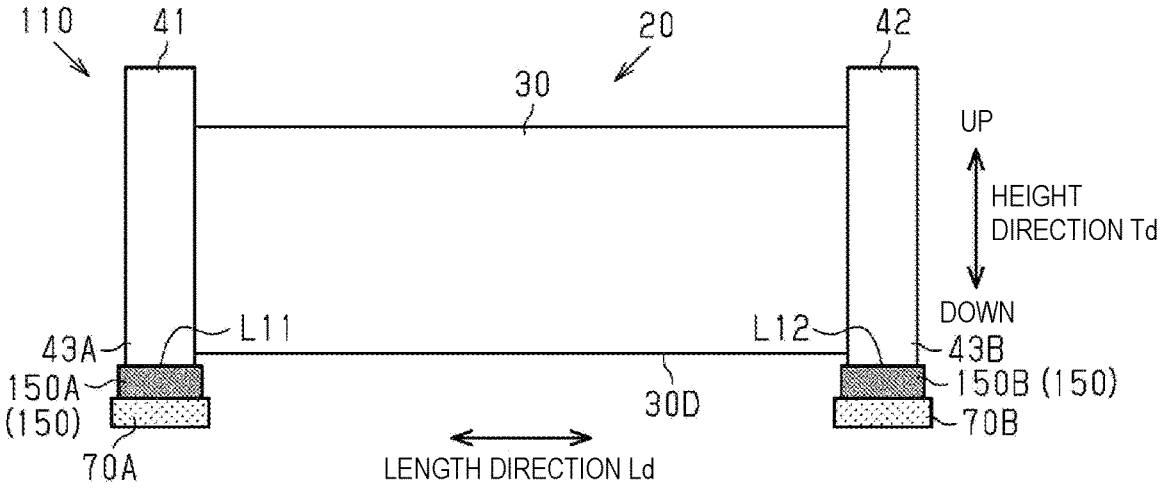
FIG. 7 is a side view of an electronic component of a second embodiment.

As illustrated in FIG. 7, in an inductor component 110 according to the second embodiment, the parts of the surfaces of the core 20 that are covered by an insulating layer 150 are different. The insulating layer 150 covers approximately the lower two-thirds in the height direction Td of the parts of the first flange part 41 and the second flange part 42 that are lower than the lower surface of the winding core part 30, among the outer peripheral surfaces of the winding core part 30, in the height direction Td. As a result, a first boundary L11 and a second boundary L12 between the parts of the surfaces of the core 20 covered by the insulating layer 150 and the parts of the surfaces of the core 20 not covered by the insulating layer 150 are located on the first protruding portion 43A and the second protruding portion 43B. Regions extending from the first boundary L11 and the second boundary L12 to the lower ends in the height direction Td of the first flange part 41 and the second flange part 42, which are the protruding leading ends of the first flange part 41 and the second flange part 42, are covered by the insulating layer 150.

Figure 8:
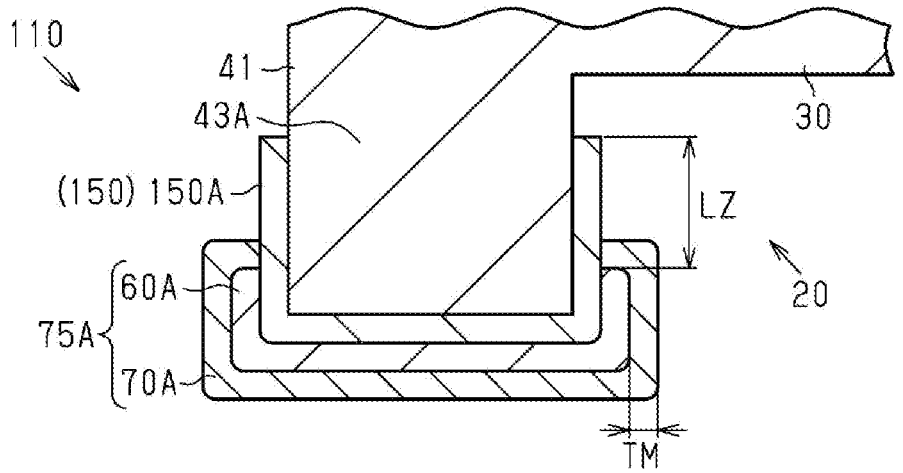
FIG. 8 is an enlarged sectional view of the electronic component of the second embodiment.

The thickness TM of the first plating layer 70A stacked on the surface of a first insulating layer 150A, as illustrated in FIG. 8, is approximately 20 μm. Furthermore, a minimum distance LZ, which is the minimum value of a distance from the edge of the first base electrode 60A to the edge of the first insulating layer 50A, is approximately 20 μm. Therefore, the thickness TM of the first plating layer 70A is approximately 1.0 times the minimum distance LZ, which is within 1.5 times the minimum distance LZ. Furthermore, the thickness TM of the second insulating layer 50B is identical.

Next, a method of manufacturing the inductor component 110 will be described.

Figure 9:
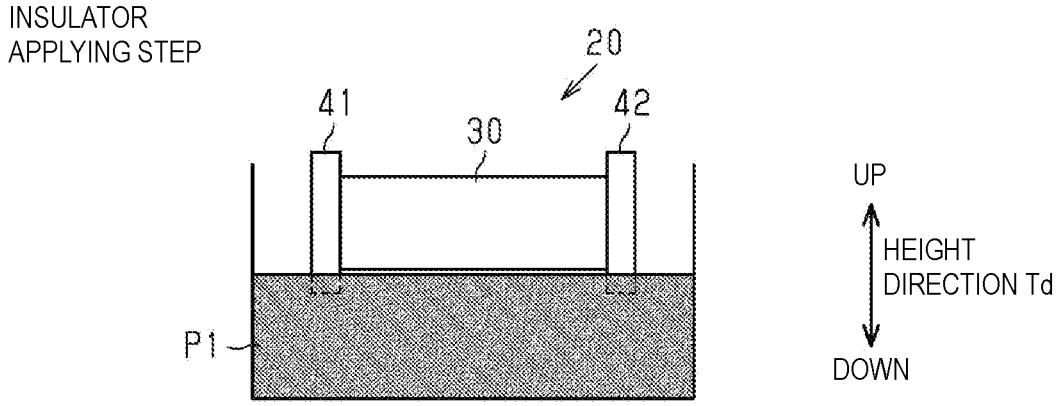
FIG. 9 is an explanatory diagram for an insulator applying step of the second embodiment.

As illustrated in FIG. 9, after molding the core 20 in the core preparing step, the insulator sol P1 containing a metal alkoxide is applied to the lower parts of the core 20 in the height direction Td in the insulator applying step. Specifically, the insulator sol P1 is applied to approximately the lower two thirds in the height direction Td of the parts of the first flange part 41 and the second flange part 42 that protrude beyond the outer peripheral surface of the winding core part 30. At this time, the insulator sol P1 is applied to both the first flange part 41 and the second flange part 42 by dipping, or in other words immersing, the lower side of the core 20 in the height direction Td in the insulator sol P1 in a single immersion. Then, the insulator sol P1 is dried.

Figure 10:
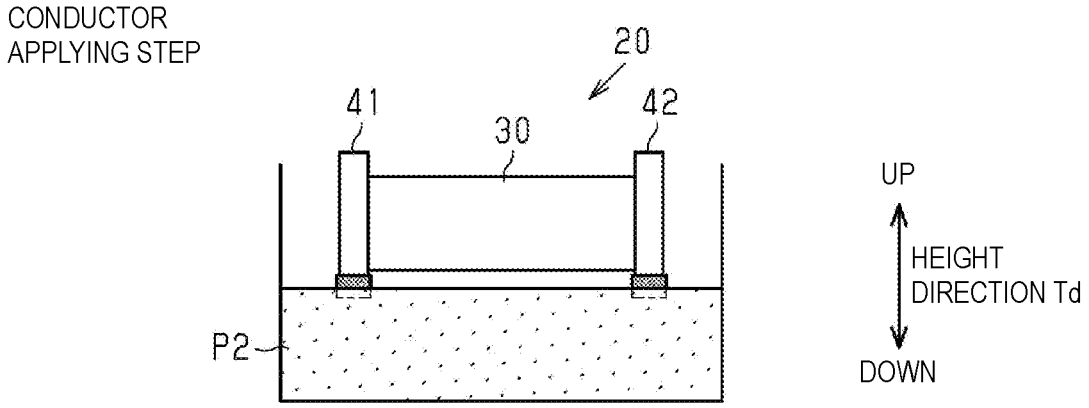
FIG. 10 is an explanatory diagram for a conductor applying step of the second embodiment.

After that, as illustrated in FIG. 10, the conductor sol P2, which contains a metal alkoxide, is applied to lower parts in the height direction Td of the regions to which the insulator sol P1 has been applied by performing the conductor applying step. Specifically, the conductor sol P2 is applied so that the upper ends of the regions to which the conductor sol P2 is applied are located below the upper ends of the insulator sol P1 applied to the core 20. Then, the conductor sol P2 that has been applied to the core 20 is dried. After that, the heating step and the plating step are performed.

Next, the actions and effects of the above-described second embodiment will be described. The following effects are achieved in addition to effects (1) to (3) and (8) to (10) of the above-described first embodiment.

(11) According to the second embodiment, the regions of the surfaces of the core 20 that are covered by the insulating layer 50 consist of a part of the first protruding portion 43A and a part of the second protruding portion 43B. Therefore, the regions coated with the insulator sol P1 in the insulator applying step are reasonably small. Therefore, the amount of insulator sol P1 used is small.

(12) According to the second embodiment, the thickness TM of the first plating layer 70A is less than or equal to 1.5 times the minimum distance LZ, which is the minimum value of the distance from the edge of the first base electrode 60A to the edge of the first insulating layer 50A. Therefore, an increase in the overall size of the inductor component 110 can be suppressed as a result of the thickness TM of the first plating layer 70A being reasonably small.

(13) In the second embodiment, the insulator sol P1 is applied by dipping, or in other words immersing, a fixed region of the core 20 from the lower end of the core 20 in the height direction Td in the insulator sol P1 in the insulator applying step. Therefore, the insulator sol P1 can be applied to both the first flange part 41 and the second flange part 42 in a single immersion. Therefore, the application of the insulator sol P1 carried out in the insulator applying step can be completed in a single operation.

The above-described embodiments can be modified in the following ways. The embodiments and the following modifications can be combined with each other to the extent that they are not technically inconsistent.

- In the embodiments, the materials of the insulating layer 50 and the first base electrode 60A are not limited to the examples given in the embodiments. The material of the insulating layer 50 only needs to be a material having a higher insulating property than the core 20 and for example the material may be a crystalline glass or resin, an inorganic oxide, a ceramic, or the like. It is sufficient that the material of the first base electrode 60A be a material through which electricity flows and on which the first plating layer 70A can be stacked in the plating step, and for example, may consist of just silver or may include copper. In addition, the material of the first base electrode 60A may be a composite material consisting of a resin and a metal. This is also the case for the materials of the insulating layer 50 and the second base electrode. In addition, the materials of the first base electrode 60A and the second base electrode may be different from each other.
- In the embodiments, the relationship between the material of the insulating layer 50 and the material of the first base electrode 60A is not limited to the example given in the embodiments. For example, the material of the insulating layer 50 may be a glass component containing titanium and the material of the first base electrode 60A may be a component including titanium and silver. In this case, titanium is a shared inorganic component. Furthermore, the material of the insulating layer 50 and the material of the first base electrode 60A do not have to include a shared inorganic component. The material of the insulating layer 50 and the material of the first base electrode 60A may be sintered materials sintered in the heating step. The above points also apply to the relationship between the material of the insulating layer 50 and the material of the second base electrode.
- In the embodiments, the thickness of the insulating layer 50 is not limited to the example given in the above embodiments. For example, the maximum thickness of the first insulating layer 50A at a position 0.6 times the thickness of the first plating layer 70A away from the edge of the first base electrode 60A toward the edge of the first insulating layer 50A may be greater than 1.5 μm and the minimum thickness of the insulating layer 50 at that position may be less than 10 nanometers. For example, the thickness of the first insulating layer 50A may be designed by taking into account the weight that is acceptable for the inductor component 10, the voltage that will be applied when depositing the first plating layer 70A, and so on.
- In the above first embodiment, the curvature of the parts of the insulating layer 50 covering the first connection point 21A and the second connection point may be the same as or larger than the curvature of the connection points of the core 20. Note that in the case where the curvature of the parts of the insulating layer 50 covering the first connection point 21A and the second connection point are the same as the curvature of the connection points of the core 20, the thickness of the insulating layer 50 will uniform along the surface of the core 20.
- In the first embodiment, the thickness of the parts of the insulating layer 50 covering the first connection point 21A and the second connection point is not limited to the example given in the first embodiment. For example, the thickness of the part of the first insulating layer 50A covering the first connection point 21A may be the same as or less than the thickness of the part of the first insulating layer 50A interposed between the first plating layer 70A and the core 20.

In the first embodiment, the position of the first boundary L1 is not limited to the example given in the first embodiment. For example, the first boundary L1 may be located on the first flange part 41 or the first boundary L1 may be located so as to span between the first flange part 41 and the winding core part 30. In this case, the arrangement of the first electrode 75A may also be changed in accordance with the range covered by the first insulating layer 50A. This point also similarly applies to the position of the second boundary L2.

In the above embodiments, the regions of the core 20 covered by the insulating layer 50 are not limited to the examples given in the embodiments. For example, in the first embodiment, the second flange part 42 side of the core 20 does not have to be covered by the second insulating layer 50B.

In the above embodiments, the first insulating layer 50A and the second insulating layer 50B may partially overlap each other. In this case, if there is a part where a portion of the core 20 is exposed from the insulating layer 50, a problem may arise in which the first plating layer 70A or the second plating layer 70B comes into contact with the exposed portion and is deposited over an excessively wide area.

In the above embodiments, the first plating layer 70A does not have to have a three-layer structure. In addition, the materials of the first plating layer 70A are also not restricted as long as the materials are capable of functioning as the first electrode 75A. These points also apply to the configuration of the second plating layer 70B.

In the above embodiments, the position of the first plating layer 70A is not limited to the examples given in the embodiments. For example, the position of the first plating layer 70A may be arranged on an end surface of the first flange part 41 in the length direction Ld. It is sufficient that the first plating layer 70A and the second plating layer 70B be at least arranged inside the regions covered by the insulating layer 50. Furthermore, the edge of the first base electrode 60A and the edge of the first insulating layer 50A may partially coincide with each other. As a result, at the places where the edge of the first base electrode 60A and the edge of the first insulating layer 50A coincide with each other, there is a risk that the first plating layer 70A will come into contact with part of the core 20 that is exposed from the first insulating layer 50A. Nevertheless, even if the first plating layer 70A is excessively deposited, there is unlikely to be a problem so long as these places are places where the winding wire 80 is unlikely to come into contact with the first plating layer 70A. This point also similarly applies to the position of the second base electrode.

In the above embodiments, the thickness TM of the first plating layer 70A is not limited to the examples given in the embodiments. It is preferable for the thickness TM of the first plating layer 70A to be less than or equal to 1.5 times the minimum distance LZ from the edge of the first base electrode 60A to the edge of the first insulating layer 50A because the thickness of the first plating layer 70A is not excessively thick and increases in the overall size and weight of the inductor component 10 can be suppressed when the thickness TM lies within this range. For example, if the thickness TM of the first plating layer 70A is less than or equal to 1.0 times the minimum distance LZ from the edge of the first base electrode 60A to the edge of the first insulating layer 50A, the thickness of the first plating layer 70A becomes smaller and thus a further reduction can be made in overall size of the inductor component 10. Note that even if the thickness TM of the first plating layer 70A is greater than 1.5 times the minimum distance LZ from the edge of the first base electrode 60A to the edge of the first insulating layer 50A, there should be no problems because excessive growth of the first plating layer 70A along the surfaces of the core 20 can be suppressed. For example, if the thickness TM of the first plating layer 70A is less than or equal to 3.0 times the minimum distance LZ from the edge of the first base electrode 60A to the edge of the first insulating layer 50A, excessive growth of the first plating layer 70A along the surfaces of the core 20 can be almost entirely suppressed. This also applies to the thickness TM of the second plating layer 70B.

In the above embodiments, the size of the core 20 is not limited to the example given in the embodiments, and various sizes are acceptable. For example, the size of the core 20 and the flange height HT may be any of the examples listed in FIG. 11.

In the above embodiments, the size of the first flange part 41 is not limited to the example given in the embodiments. For example, the flange height HT may be any of the examples listed in FIG. 11. Consequently, a value obtained by dividing the flange height HT by the dimension HM of the winding core part 30 in the height direction Td is not limited to the example given in the embodiments. For example, if the value lies in a range from 0.04 to 0.48 as illustrated in FIG. 11, the distance from the bottom surface 30D of the winding core part 30 to the protruding leading end of the first flange part 41 in the height direction Td is comparatively small. Therefore, it would be appropriate to apply the technologies of the above embodiments since the winding wire 80 and the first plating layer 70A may easily come into contact with each other. Note that even if the value obtained by dividing the flange height HT by the dimension HM of the winding core part 30 in the height direction Td is less than 0.04 or greater than 0.48, there should be no problems since excessive growth of the first plating layer 70A along the surfaces of the core 20 can be suppressed. This point also applies to the size of the second flange part 42.

In the above embodiments, the shape of the core 20 is not limited to the example given in the embodiments. For example, the shape of the winding core part 30 may be a substantially cylindrical or polygonal columnar shape other than a substantially rectangular columnar shape, the corners of the winding core part 30 may be chamfered, the corners of the winding core part 30 may be rounded, or part of each side may be curved. In addition, the first flange part 41 and the second flange part 42 may each have a substantially spherical shape or may have a substantially rectangular shape when viewed in the length direction Ld, the corners of the first flange part 41 and the second flange part 42 may be chamfered, the corners may be rounded, or part of each side may be curved. In addition, only one out of the first flange part 41 and the second flange part 42 may be provided. Furthermore, a substantially annular-shaped first flange part 41 and a substantially annular-shaped second flange part 42 may be provided on the circumferential surface of a substantially cylindrical winding core part 30 so as to be spaced apart from each other in the direction of the center axis of the cylindrical shape of the winding core part 30. In this case, the centers of the winding core part 30, the first flange part 41, and the second flange part 42 may or may not be aligned with each other when viewed in the center axis direction of the cylindrical shape.

In the above embodiments, the flange height HT is not limited to the example given in the embodiments. As described above, the flange height HT will also change depending on the size and shape of the first flange part 41 and the second flange part 42. For example, a case where the flange height HT is less than or equal to 300 μm is suitable for application of the technologies of the above embodiments.

In the above embodiments, an electronic component to which the above technologies are applied is not limited to the inductor component 10. Provided that the electronic component is at least an electronic component that includes a component body and the first plating layer 70A and the second plating layer 70B stacked on a surface of the component body, the technologies of the above embodiments can be applied.

In the second embodiment, the position of the first boundary L11 is not limited to the example given in the second embodiment. For example, the position of the first boundary L11 may be located on a part of the first protruding portion 43A of the first flange part 41 that protrudes upwardly in the height direction Td. Furthermore, the position of the first boundary L11 may be located at the position of the center axis CA of the winding core part 30 in the height direction Td. This point similarly applies to the position of the second boundary L12.

In the above embodiments, the material of the core 20 is not limited to the example given in the embodiments. For example, the material of the core 20 may be a manganese-zinc ferrite or a copper-zinc ferrite. If the material of the core 20 is a material in which a small current can flow, a problem may arise in that the first plating layer 70A and the second plating layer 70B are deposited over an excessively wide area.

In the above embodiments, the method of applying the insulating layer 50 is not limited to the examples given in the embodiments. For example, an insulator and a conductor may be stacked on a surface of the core 20 by performing printing or the like. This point also applies to the method of applying the first base electrode 60A and the second base electrode.

In the above embodiments, the number of times a conductor is applied in the conductor coating step is not limited to the examples given in the embodiments. For example, in the embodiments, the number of times a conductor is applied and the places where the conductor is applied may be changed in accordance with the areas that are to be covered by the first base electrode 60A and the second base electrode. This point also applies to the insulator applying step.

In the embodiments, the step of hardening the insulator sol P1 to form the first insulating layer 50A and the second insulating layer 50B is not limited to the heating step. Any hardening step that enables the insulator sol P1 to be hardened to form the first insulating layer 50A and the second insulating layer 50B is acceptable. For example, a hardening step utilizing ultraviolet radiation may be used.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. An electronic component comprising:

a component body including a core having a winding core part;

an insulating layer that comprises a material having a higher insulating property than the component body and that partially covers a surface of the component body; and an electrode that is stacked on a surface of the insulating layer;

wherein the electrode includes a base electrode that is stacked on the surface of the insulating layer and a plating layer that is stacked on a surface of the base electrode, and the insulating layer has a larger surface area than the electrode and the electrode is stacked at a position separated from an edge of the insulating layer, the edge of the insulating layer being present along the winding core part of the core at a position spaced from a flange part so that a portion of the winding core part is exposed beginning at the edge of the insulating layer.

2. The electronic component according to claim 1, wherein a thickness of the plating layer is less than or equal to 1.5 times a minimum distance from an edge of the base electrode to the edge of the insulating layer.

3. The electronic component according to claim 1, wherein the component body includes a substantially column-shaped winding core part and a flange part that is connected to an end of the winding core part in a center axis direction of the winding core part, the flange part includes a protruding portion that protrudes outwardly from one surface of the winding core part among outer peripheral surfaces of the winding core part that are parallel to the center axis direction of the winding core part, a winding wire is wound around the winding core part, the insulating layer covers at least part of the protruding portion, and the electrode is provided on the protruding portion of the flange part.

4. The electronic component according to claim 3, wherein the flange part consists of a first flange part that is connected to a first end of the winding core part in the center axis direction and a second flange part that is connected to a second end of the winding core part in the center axis direction, the first flange part and the second flange part are each provided with the protruding portion, and the protruding portion of the first flange part and the protruding portion of the second flange part are each provided with the electrode.

5. The electronic component according to claim 3, wherein the insulating layer covers at least part of a leading end of the protruding portion in a protruding direction of the protruding portion, when a length from the one surface to the leading end in a direction perpendicular to the center axis is a flange height, a value obtained by dividing the flange height of the part of the flange part covered by the insulating layer by a dimension of the winding core part in a direction perpendicular to the center axis of the winding core part lies in a range from 0.04 to 0.48.

6. The electronic component according to claim 3, wherein the insulating layer covers at least part of a leading end of the protruding portion in a direction perpendicular to the center axis direction, and when a length from the one surface to the leading end of the protruding portion in the direction perpendicular to the center axis is a flange height, the flange height of the part of the flange part that is covered by the insulating layer is less than or equal to 300 μm.

7. The electronic component according to claim 3, wherein the insulating layer covers the flange part, and a boundary between a part covered by the insulating layer and a part not covered by the insulating layer is located on the winding core part.

8. The electronic component according to claim 3, wherein the insulating layer covers a connection point between the one surface and the protruding portion, and a surface of a part of the insulating layer that covers the connection point is curved, and a curvature of the surface is smaller than a curvature of the connection point when viewed in a cross section including the center axis of the winding core part.

9. The electronic component according to claim 3, wherein the insulating layer covers a connection point between the one surface and the protruding portion, and a thickness of a part of the insulating layer that covers the connection part is larger than a thickness of a part of the insulating layer interposed between the electrode and the component body.

10. The electronic component according to claim 3, wherein a boundary between a part covered by the insulating layer and a part not covered by the insulating layer is located on the protruding portion of the flange part, and a region from the boundary to a leading end of the protruding portion is covered by the insulating layer.

11. The electronic component according to claim 1, wherein a minimum thickness of the insulating layer at a position at a distance of 0.6 times a thickness of the plating layer from an edge of the base electrode toward the edge of the insulating layer is greater than or equal to 10 nanometers.

12. The electronic component according to claim 1, wherein a maximum thickness of the insulating layer at a position at a distance of 0.6 times a thickness of the plating layer from the edge of the base electrode toward the edge of the insulating layer is less than or equal to 1.5 μm.

13. The electronic component according to claim 1, wherein the electrode includes a base electrode that is stacked on the surface of the insulating layer and a plating layer that is stacked on a surface of the base electrode, and the material of the insulating layer and a material of the base electrode include a shared inorganic component.

14. The electronic component according to claim 2, wherein the component body includes a substantially column-shaped winding core part and a flange part that is connected to an end of the winding core part in a center axis direction of the winding core part, the flange part includes a protruding portion that protrudes outwardly from one surface of the winding core part among outer peripheral surfaces of the winding core part that are parallel to the center axis direction of the winding core part, a winding wire is wound around the winding core part, the insulating layer covers at least part of the protruding portion, and the electrode is provided on the protruding portion of the flange part.

15. The electronic component according to claim 4, wherein the insulating layer covers at least part of a leading end of the protruding portion in a protruding direction of the protruding portion, when a length from the one surface to the leading end in a direction perpendicular to the center axis is a flange height, a value obtained by dividing the flange height of the part of the flange part covered by the insulating layer by a dimension of the winding core part in a direction perpendicular to the center axis of the winding core part lies in a range from 0.04 to 0.48.

16. The electronic component according to claim 4, wherein the insulating layer covers at least part of a leading end of the protruding portion in a direction perpendicular to the center axis direction, and when a length from the one surface to the leading end of the protruding portion in the direction perpendicular to the center axis is a flange height, the flange height of the part of the flange part that is covered by the insulating layer is less than or equal to 300 μm.

17. The electronic component according to claim 4, wherein the insulating layer covers the flange part, and a boundary between a part covered by the insulating layer and a part not covered by the insulating layer is located on the winding core part.

18. The electronic component according to claim 4, wherein the insulating layer covers a connection point between the one surface and the protruding portion, and a surface of a part of the insulating layer that covers the connection point is curved, and a curvature of the surface is smaller than a curvature of the connection point when viewed in a cross section including the center axis of the winding core part.

19. A method of manufacturing an electronic component that includes a component body including a core having a winding core part, an insulating layer comprising a material having a higher insulating property than the component body and that partially covers a surface of the component body, and an electrode that includes a base electrode is stacked on a surface of the insulating layer, the method comprising:

preparing an insulator having a higher insulating property than the component body and a conductor having a higher conductivity than the insulator;

applying the insulator to part of a surface of the component body by dipping part of the component body in the insulator;

applying the conductor to part of a surface of the insulator by dipping part of the surface of the insulator applied to the surface of the component body in the conductor, such that the conductor is applied over a smaller area than the insulating layer;

hardening the insulator to form the insulating layer and hardening the conductor to form the base electrode; and forming an electrode on a surface of the base electrode by plating, wherein the insulating layer has a larger surface area than the electrode and the electrode is stacked at a position separated from an edge of the insulating layer, the edge of the insulating layer being present along the winding core part of the core at a position spaced from a flange part so that a portion of the winding core part is exposed beginning at the edge of the insulating layer.

20. The method of manufacturing an electronic component according to claim 19, wherein the insulator is a thermo-hardening insulator, the conductor is a thermo-hardening conductor, and the insulator and the conductor are heated together in the hardening to change the insulator into the insulating layer and change the conductor into the base electrode.

* * * * *